US010723131B2

(12) United States Patent
Atake

(10) Patent No.: US 10,723,131 B2
(45) Date of Patent: Jul. 28, 2020

(54) LIQUID DISCHARGING DEVICE AND CLEANING METHOD

(71) Applicant: Takumi Atake, Kanagawa (JP)

(72) Inventor: Takumi Atake, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/297,227

(22) Filed: Mar. 8, 2019

(65) Prior Publication Data

US 2019/0283430 A1 Sep. 19, 2019

(30) Foreign Application Priority Data

Mar. 13, 2018 (JP) ..... 2018-045240

(51) Int. Cl.
*B41J 2/165* (2006.01)

(52) U.S. Cl.
CPC ..... *B41J 2/16535* (2013.01); *B41J 2/16544* (2013.01); *B41J 2/16552* (2013.01); *B41J 2002/1655* (2013.01); *B41J 2002/16558* (2013.01)

(58) Field of Classification Search
CPC ..... B41J 2/16535; B41J 2/16544; B41J 2/16552; B41J 2002/1655; B41J 2/16558
USPC ..... 347/33
See application file for complete search history.

(56) References Cited

U.S. PATENT DOCUMENTS

2012/0050394 A1 3/2012 Takada et al.
2014/0292919 A1* 10/2014 Kobayashi ..... B41J 2/16535 347/33
2017/0253044 A1* 9/2017 Ohnishi ..... B41J 2/16505

FOREIGN PATENT DOCUMENTS

JP 2014-000704 1/2014
JP 2014-104746 A 6/2014
JP 2014-108594 6/2014

OTHER PUBLICATIONS

Extended European Search Report dated Jul. 5, 2019 in European Patent Application No. 19162095.4, citing documents AA-AB and AO therein, 8 pages.

* cited by examiner

*Primary Examiner* — Huan H Tran
*Assistant Examiner* — Alexander D Shenderov
(74) *Attorney, Agent, or Firm* — Oblon, McClelland, Maier & Neustadt, L.L.P.

(57) ABSTRACT

A liquid discharging device includes a liquid discharging head including a nozzle surface and multiple nozzles, the liquid discharging head to discharge liquid through the nozzles, a wiping member to wipe the nozzle surface of the liquid discharging head, and a pressing member to press the wiping member against the nozzle surface when the wiping member wipes the nozzle surface, wherein the wiping member satisfies the following conditions 1 and 2 when the wiping member is pressed against the nozzle surface by the pressing member during wiping: the contact ratio of the wiping member with the nozzle surface is from 60 to 95 percent Condition 1, the porous volume per unit area represented by V×T/100 is from 0.1 to 0.7 ($mm^3/mm^2$), where V (percent) represents a porosity and T (mm) represents a thickness of the wiping member Condition 2.

10 Claims, 5 Drawing Sheets

LIQUID DISCHARGING DEVICE AND CLEANING METHOD

CROSS-REFERENCE TO RELATED APPLICATIONS

This patent application is based on and claims priority pursuant to 35 U.S.C. § 119 to Japanese Patent Application No. 2018-045240 filed on Mar. 13, 2018 in the Japan Patent Office, the entire disclosure of which is hereby incorporated by reference herein.

BACKGROUND

Technical Field

The present invention relates to a liquid discharging device and a cleaning method.

Description of the Related Art

For example, a liquid discharging device (inkjet recording device) that includes a liquid discharging head or a liquid discharging unit to discharge liquid is known as an image forming device (apparatus) for a printer, a facsimile, a copier, a plotter, a multifunction peripheral thereof, etc.

SUMMARY

According to the present disclosure, provided is an improved liquid discharging device which includes a liquid discharging head including a nozzle surface and multiple nozzles, the liquid discharging head being configured to discharge liquid through the nozzles, a wiping member configured to wipe the nozzle surface of the liquid discharging head, and a pressing member configured to press the wiping member against the nozzle surface when the wiping member wipes the nozzle surface, wherein the wiping member satisfies the following conditions 1 and 2 when the wiping member is pressed against the nozzle surface by the pressing member during wiping: the contact ratio of the wiping member with the nozzle surface is from 60 to 95 percent Condition 1, the porous volume per unit area represented by $V \times T/100$ is from 0.1 to 0.7 ($mm^3/mm^2$), where V (percent) represents a porosity and T (mm) represents a thickness of the wiping member Condition 2.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

Figure 1:
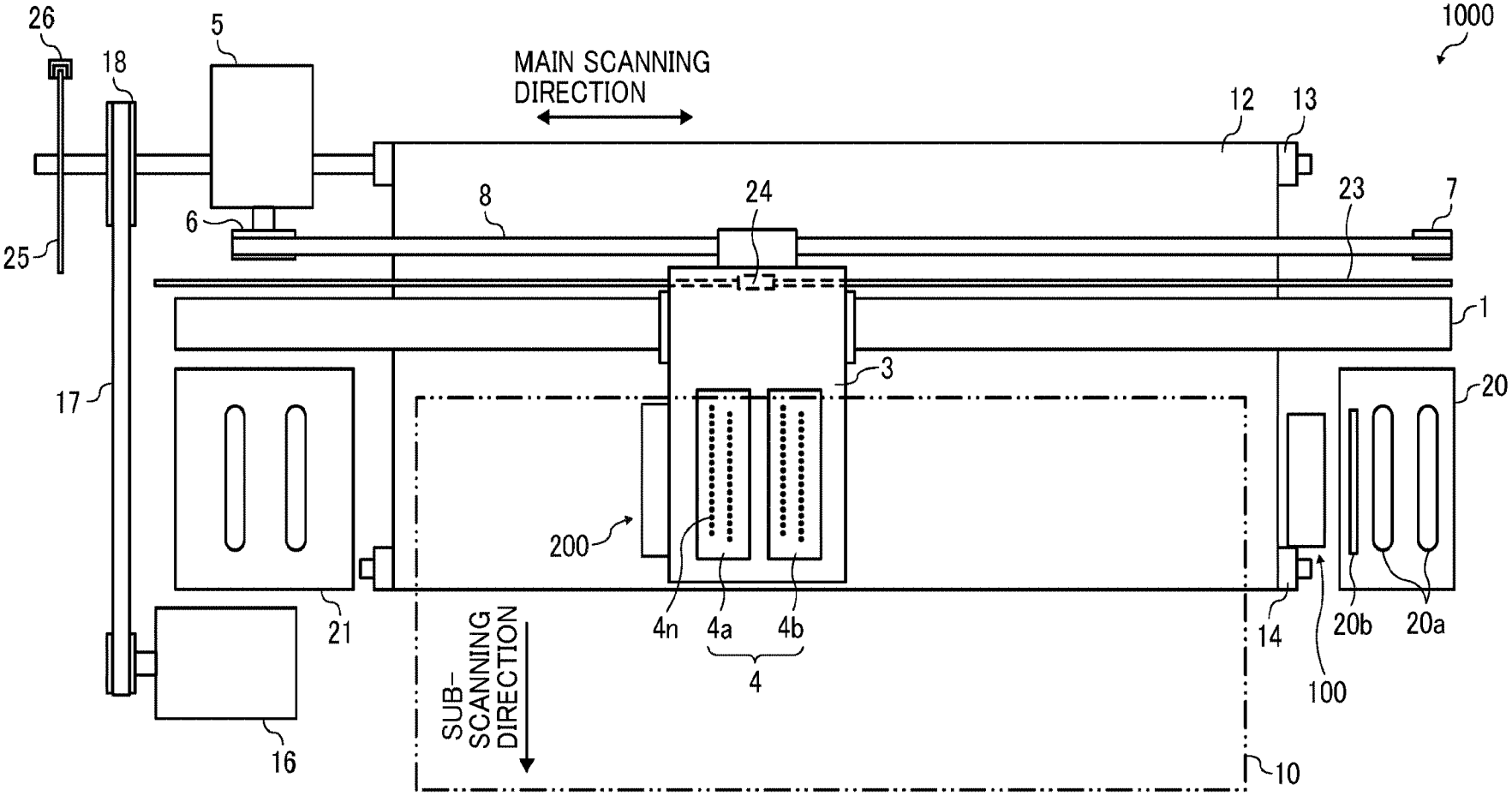
FIG. 1 is a diagram illustrating a planar view of a mechanism of the liquid discharging device according to an embodiment of the present disclosure.

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF THE EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Moreover, image forming, recording, printing, modeling, etc. in the present disclosure represent the same meaning, unless otherwise specified.

Embodiments of the present invention are described in detail below with reference to accompanying drawing(s). In describing embodiments illustrated in the drawing(s), specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

A liquid discharging device (inkjet recording device) that includes a liquid discharging head or a liquid discharging unit to discharge liquid requires periodic cleaning because foreign matter on a nozzle surface of a liquid discharging head may cause malfunctioning such as faulty discharging.

An example of foreign matter on a nozzle surface is ink adhering thereto as a result of drying of the ink. In particular, ink having good fixability is disadvantageously likely to adhere to the nozzle surface and other places.

A device is known that includes a mechanism for wipe-cleaning such ink adhering to the nozzle surface of a head by bringing a long liquid-absorbable wiping member made of, for example, a non-woven fabric into contact with the nozzle surface and sliding the wiping member along the nozzle surface.

However, such a cleaning method using a liquid-absorbable wiping member to remove ink adhering to the nozzle surface is inefficient and may cause an adverse impact, for example, a water-repellent film formed on the nozzle surface deteriorates as the number of wiping operations increases. Even if the wiping member is impregnated with a cleaning liquid, it is difficult to prevent abrasion ascribable to the wiping member, particles in ink components, etc.

To reduce damage to a nozzle periphery caused by the contact with such a wiping member, a configuration has been proposed in which the pressure applied onto the nozzle periphery on a nozzle surface is lower than the pressure applied onto the area other than the nozzle periphery.

However, it is difficult to increase removal efficiency of the ink adhering to the nozzle surface by such a method in which the pressing force is adjusted to reduce the damage ascribable to the contact of a wiping member with a nozzle surface.

According to the present disclosure, a liquid discharging device is provided which can efficiently remove ink adhering to a nozzle surface.

The liquid discharging device and the cleaning method of the present disclosure will now be described with reference to accompanying drawings. It is to be noted that the following embodiments are not limiting the present disclosure and any deletion, addition, modification, change, etc. can be made within a scope in which man in the art can conceive including other embodiments, and any of which is included within the scope of the present disclosure as long as the effect and feature of the present disclosure are demonstrated.

FIG. 1 is a diagram illustrating a serial image forming device, which is a liquid discharging device 1000 according to one exemplary embodiment of the present invention.

FIG. 1 is a diagram illustrating a planar view of the mechanism of the liquid discharging device 1000.

The liquid discharging device 1000 according to this embodiment includes a primary guiding member 1 laterally bridged between left and right side plates, a secondary guiding member, and a carriage 3 movably supported by the primary guiding member 1 and the secondary guiding member. A main scanning motor 5 drives the carriage 3 to reciprocate in the main scanning direction (carriage moving direction) via a timing belt 8 looped around a drive pully 6 and a driven pully 7.

The carriage 3 carries liquid discharging heads 4*a* and 4*b* (referred to as liquid discharging head 4 if distinction thereof is not necessary). The liquid discharging head 4 discharges color ink droplets of, for example, yellow (Y), cyan (C), magenta (M), and black (K).

The liquid discharging head 4 carries nozzle arrays Na and Nb each having multiple nozzles 4*n* disposed along the sub-scanning direction vertical to the main scanning direction with the ink discharging surface downward.

Figure 2:
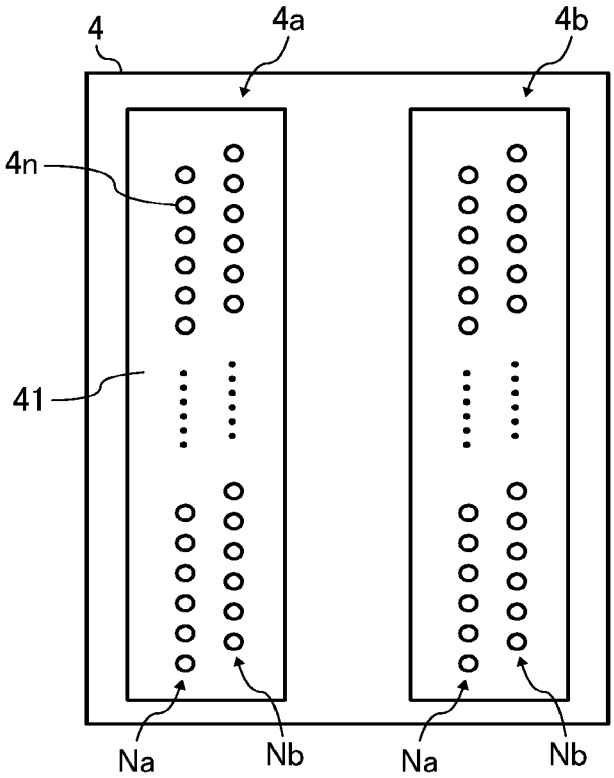
FIG. 2 is a schematic diagram illustrating an example of the wiping-target nozzle surface of a liquid discharging head.

Nozzle surfaces 41*a* and 41*b* (referred to as nozzle surface 41 when not distinguished from each other) of the liquid discharging heads 4*a* and 4*b* are illustrated in FIG. 2.

The nozzle plate illustrated in FIG. 2 has two nozzle arrays Na and Nb, each including multiple nozzles 4*n*. For example, one nozzle array Na of the liquid discharging head 4*a* discharges black (K) droplets and the other nozzle array Nb discharges cyan (C) droplets. One nozzle array Na of the liquid discharging head 4*b* discharges magenta (M) droplets and the other nozzle array Nb discharges yellow (Y) droplets.

As the liquid discharging head 4, for example, it is possible to use a piezoelectric actuator such as a piezoelectric element and a thermal actuator that utilizes the phase change caused by film boiling of liquid by using an electric heat conversion element such as a heat element.

The liquid discharging head 4 has a sheet conveyor belt 12 serving as a conveying device to convey the sheet 10 at the position facing the liquid discharging head 4 by electrostatic adsorption. The sheet conveyor belt 12 takes an endless form, looped around a belt conveyor roller 13 and a tension roller 14.

The sheet conveyor belt 12 is moved around in the sub-scanning direction by the belt conveyor roller 13 rotationally driven by the sub-scanning motor 16 via a timing belt 17 and a timing pully 18. This sheet conveyor belt 12 is charged (electric charges are applied) by a charging roller while moving around.

At one end in the main-scanning direction of the carriage 3, a maintenance and recovery mechanism (cleaning unit) 20 configured to maintain and recover the liquid discharging head 4 is disposed beside the sheet conveyor belt 12. On the other end, a dummy discharging receiver 21 configured to receive dummy discharging from the liquid discharging head 4 is disposed beside the sheet conveyor belt 12.

The maintenance and recovery mechanism 20 includes, for example, a capping member 20*a* to cap a nozzle surface (surface on which the nozzle is formed) 41 (FIG. 4) of the liquid discharging head 4, a wiping mechanism 20*b* to wipe the nozzle surface, and the dummy discharging receiver to receive droplets not used to form an image.

The wiping mechanism 20*b* includes at least a long liquid-absorbable wiping member 320 (hereinafter simply referred to as wiping member) described later and may further include a blade-like member formed of an elastic material (e.g., rubber).

A discharging detection unit 100 is disposed in a non-recording area between the sheet conveyor belt 12 and the maintenance and recovery mechanism 20, where the discharging detection unit 100 can face the liquid discharging head 4. The carriage 3 is provided with a cleaning unit 200 configured to clean an electrode plate 101 of the discharging detection unit 100.

In addition, an encoder scale 23 forming a particular pattern is tensioned between both side plates along the main-scanning direction of the carriage 3, and the carriage 3 has an encoder sensor 24 including a transmission photosensor that reads the pattern of the encoder scale 23. These encoder scale 23 and the encoder sensor 24 constitute a linear encoder (main scanning encoder) to detect the movement of the carriage 3.

In addition, a cord wheel 25 is provided to the shaft of the belt conveyor roller 13, and an encoder sensor 26 having a transmission photosensor to detect a pattern formed on the cord wheel 25 is provided. These cord wheel 25 and the encoder sensor 26 constitute a rotary encoder (sub-scanning encoder) to detect the movement and the position of the sheet conveyor belt 12.

In the liquid discharging device 1000 having such a configuration, the sheet 10 is fed from a sheet feeder tray, adsorbed to the sheet conveyor belt 12, and conveyed along the sub-scanning direction in accordance with the rotation of the sheet conveyor belt 12.

By driving the liquid discharging head 4 in response to the image signal while moving the carriage 3 in the main-scanning direction, ink droplets are discharged onto the sheet 10 standing still to record an image in an amount of one line. After the sheet 10 is conveyed in a predetermined amount, the next line is recorded.

On receiving a signal indicating that the recording has completed or the rear end of the sheet 10 has reached the image recording area, the recording stops and the sheet 10 is ejected to a sheet ejection tray.

In addition, the carriage 3 is moved to the maintenance and recovery mechanism (cleaning unit) 20 while in the printing (recording) standby mode to clean the liquid discharging head 4.

How the wiping mechanism 20*b* of the maintenance and recovery mechanism 20 is configured and cleans the liquid discharging head 4 will be described with reference to FIG. 3, FIG. 6, and FIG. 7.

Figure 3:
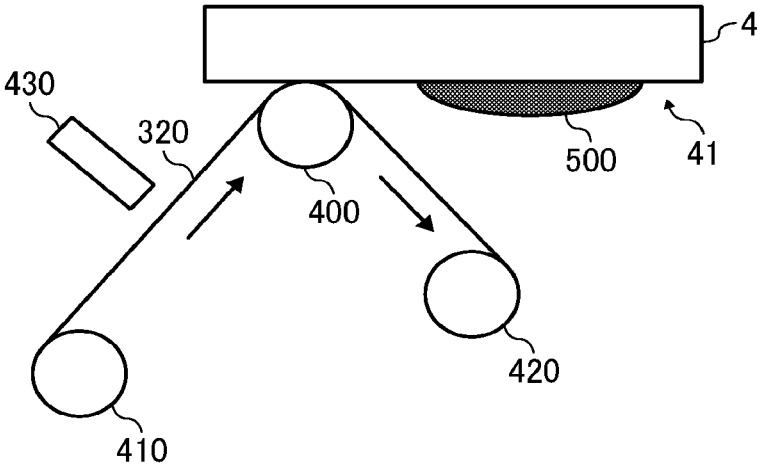
FIG. 3 is a schematic diagram illustrating a side view of a configuration of a wiping mechanism and an ink adhering to the wiping target nozzle surface.

FIG. 3 is a schematic diagram illustrating a side view of a configuration of the wiping mechanism 20*b* and an ink 500 adhering to the nozzle surface 41 to be wiped.

Figure 6:
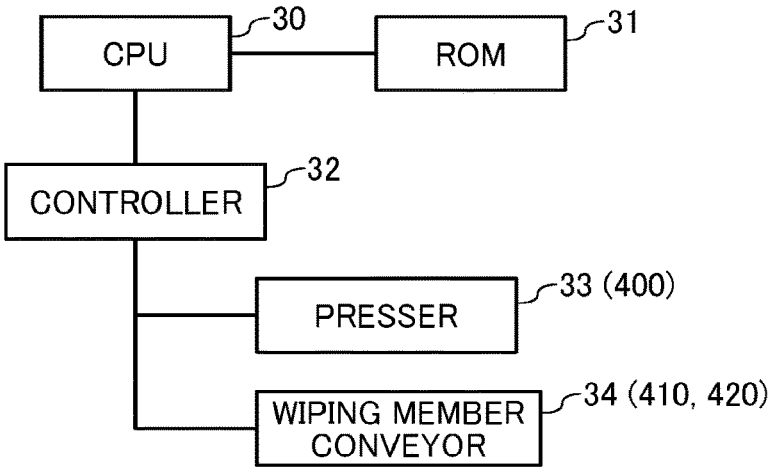
FIG. 6 is a block diagram illustrating a configuration of a controller of the wiping mechanism.

FIG. 6 is a block diagram illustrating how to control the wiping mechanism 20*b*. FIG. 7 is a flowchart illustrating a procedure of the cleaning method.

The liquid discharging device 1000 according to this embodiment includes the liquid discharging head 4 configured to discharge liquid through the nozzles 4*n* and the wiping mechanism 20*b* illustrated in FIG. 3 as described above.

The wiping mechanism 20*b* includes the wiping member 320 to wipe the nozzle surface 41 of the liquid discharging head 4, a wiping member conveyor 34 configured to longitudinally convey the wiping member 320, a pressing member 33 configured to press the wiping member 320 against the nozzle surface 41 during wiping, and a controller 32 configured to control the wiping member conveyor 34 and the pressing member 33.

The pressing member 33 includes a pressing roller 400 and a spring. The pressing force applied to the nozzle surface 41 by the pressing member 33 can be adjusted by the distance between the wiping member 320 and the nozzle surface 41. The controller 32 controls the pressing force.

It is preferable that the controller 32 control the pressing force to be 5 N or less.

The wiping member conveyor 34 includes a feed roller 410 configured to deliver the wiping member 320 and a wind-up roller 420 configured to wind up the wiping member 320. The tension of the wiping member 320 stretched between the feed roller 410 and the wind-up roller 420 can be adjusted by the rate of delivery by the feed roller 410 and the rate of winding-up around the wind-up roller 420. The controller 32 controls the tension.

During the wiping action for the nozzle surface 41, the pressing force of the above-described pressing member and the tension generated by the wiping member conveyor 34 are adjusted, so that the wiping member 320 wipes the nozzle surface 41 while satisfying the following conditions: To wipe the nozzle surface 41, the wiping member 320 pressed against the nozzle surface 41 relatively moves against the liquid discharging head 4.

The liquid discharging device 1000 may also include a wiping mechanism conveyor to move the wiping mechanism 20*b*.

The wiping member 320 of the liquid discharging device 1000 according to this embodiment satisfies the following conditions 1 and 2 under the pressing condition during wiping, 1. The contact ratio of the wiping member 320 with the nozzle surface 41 is from 60 to 95 percent. Condition 1

2. The porous volume per unit area represented by V×T/100 is from 0.1 to 0.7 ($mm^3/mm^2$), where V (percent) represents a porosity and T (mm) represents a thickness of the wiping member 320 Condition 2.

When the condition 1 is satisfied, the ink 500 adhering to the nozzle surface 41 is easily scraped off and when the condition 2 is satisfied, the ink 500 adhering to the nozzle surface 41 that has been scraped off is easily taken inside the wiping member 320.

Therefore, when these conditions are satisfied, the ink adhering to the nozzle surface 41 can be efficiently removed.

For the wiping member 320, any material that can satisfy the above conditions may be used. For example, a non-woven fabric is preferable. Examples of non-woven fabrics include, but are not limited to, semi-synthetic fibers such as cupra and synthetic fibers such as polyethylene terephthalate (PET), polypropylene (PP), polyethylene (PE), and nylon (Ny).

Examples of liquid-absorbable materials include, but are not limited to, porous bodies, woven fabrics, and knitted fabrics made of, for example, polyvinyl alcohol (PVA).

Condition 1

The contact ratio of the wiping member 320 with the nozzle surface 41 will be described with reference to FIG. 4 and FIG. 5.

Figure 4:
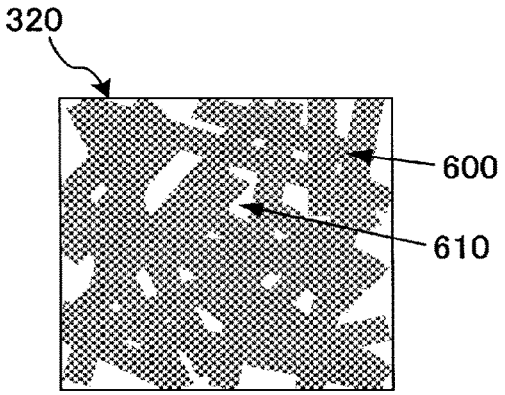
FIG. 4 is a schematic diagram illustrating an image of a wiping member pressed into contact with the nozzle surface, the image being three-dimensionally observed from the contact surface side.

FIG. 4 is a schematic diagram illustrating an image of the non-woven fabric as the wiping member 320 pressed against the nozzle surface 41. The image is three-dimensionally observed from the contact surface side.

When observed with a focus on the boundary between the wiping member 320 and the nozzle surface 41, a contact part 600 where the fiber of the non-woven fabric is in contact with the nozzle surface 41 and a non-contact part 610 are found.

When the percentage of the area (hereinafter referred to as contact ratio) of the contact part 600 in the total area is from 60 to 95 percent, great load is applied to the ink 500 adhering to the nozzle surface 41 by the fibers, thereby enhancing scraping properties.

When the contact ratio is less than 60 percent, the frequency of contact between the fibers and the ink 500 adhering to the nozzle surface 41 decreases, which degrades scraping properties. When the contact ratio surpasses 95 percent, the load applied to the ink 500 adhering to the nozzle surface 41 is dispersed, which degrades scraping properties.

The contact ratio is preferably from 60 to 80 percent.

FIG. 5 is a diagram illustrating an exemplary method of obtaining the observation image illustrated in FIG. 4.

Figure 5A:
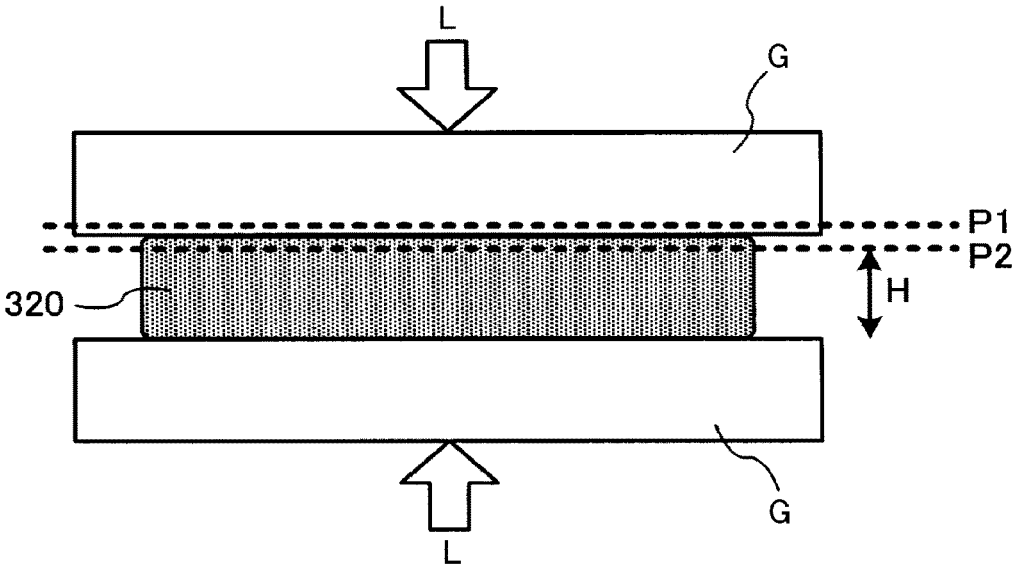
FIGS. 5A, 5B, and 5C are diagrams illustrating an exemplary method for obtaining the image illustrated in FIG. 4.

As illustrated in FIG. 5A, the wiping member 320 is sandwiched between transparent glass plates G and secured under certain load indicated by the arrows L.

In this state, the contact part between one of the glass plates G and the wiping member 320 is searched for using a laser microscope. By scanning (observation) from the position (P2, in FIG. 5A) slightly distant from the contact part 600 toward the wiping member 320, the contact state of the contact surface can be observed.

Since the laser microscope is used, the obtained data includes the height information.

Figure 5B:
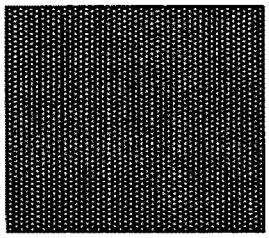
Figure 5C:
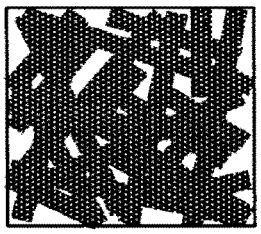

A uniform observation image as illustrated in FIG. 5B is obtained at a part in the glass plate G (e.g., the position designated at P1 in FIG. 5A), while a fibrous observation image as illustrated in FIG. 5C is obtained at a part in the wiping member 320 (e.g., the region designated by H in FIG. 5A). This makes it relatively easy to find out the image of the contact surface at the outermost surface.

In other words, an image of the contact surface can be obtained by observing the region designated by H in FIG. 5A and selecting the outermost surface part.

For the value of the certain load applied during the observation, the value obtained by measuring the load applied to the nozzle surface 41 by the wiping member 320 in the liquid discharging device 1000 can be assigned. For example, the load can be measured using a sensor sheet (I-SCAN40 manufactured by NITTA Corporation).

Condition 2

The porous volume per unit area of the wiping member 320 will be described.

The porous volume of the wiping member 320 is determined as follows.

$$\text{Porous volume}(mm^3)=\text{porosity } V\,(\%)\times\text{thickness } T(mm) \text{ of wiping member}\times\text{area}(mm^2)$$

When the porous volume per unit area ($mm^3/mm^2$) is calculated from the above relation based on the thickness under the pressure during wiping, the obtained value is from 0.1 to 0.7.

When the porous volume per unit area of the wiping member 320 under the pressure during wiping is from 0.1 to 0.7 $mm^3/mm^2$, the ink 500 adhering to the nozzle surface that has been scraped off readily enters inter-fiber spaces.

When the porous volume per unit area is less than 0.1 $mm^3/mm^2$, absorbing the ink 500 adhering to the nozzle surface 41 that has been scraped off. When the porous volume per unit area surpasses 0.7 $mm^3/mm^2$, capillary action is weak, leading to low absorbency.

The porous volume per unit area is more preferably from 0.3 to 0.5 ($mm^3/mm^2$).

Porosity (%) in the above relation is calculated as follows.

The basis weight (weight per unit area) [$g/m^2$] of the wiping member 320 is measured to calculate the density of the wiping member 320. The basis weight is calculated by measuring the weight of a non-woven fabric cut to a particular area (e.g., 50,000 $mm^2$ or more) and dividing the weight by the area.

The porosity (%) per volume is calculated by the following formula using the ratio of the actually measured density A to the theoretical density B of the material of the wiping member 320.

$$\{1-(A/B)\}\times 100$$

As illustrated in FIG. 6, the controller 32 controls the pressing member 33 and the wiping member conveyor 34 in accordance with the processing by a central processing unit (CPU) 30 that has read information of the wiping member 320 stored in a read-only memory (ROM) 31.

The information of the wiping member 320 includes porosity, thickness, etc. required for the control to satisfy the above conditions. The information of the wiping member 320 may be selected from several preliminarily stored values or may be individually input by a user.

The method of cleaning the liquid discharging head 4 according to an embodiment of the present disclosure using the liquid discharging device 1000 includes pressing the wiping member 320 against the nozzle surface 41 of the liquid discharging head 4 provided with one or more nozzles 4*n* through which liquid is discharged and wiping the nozzle surface 41. The wiping member 320 pressed during wiping satisfies the following conditions 1 and 2.

1. The contact ratio of the wiping member 320 with the nozzle surface 41 is from 60 to 95 percent.

2. The porous volume per unit area represented by V×T/100 is from 0.1 to 0.7 ($mm^3/mm^2$), where V (percent) represents a porosity and T (mm) represents a thickness of the wiping member 320.

Figure 7:
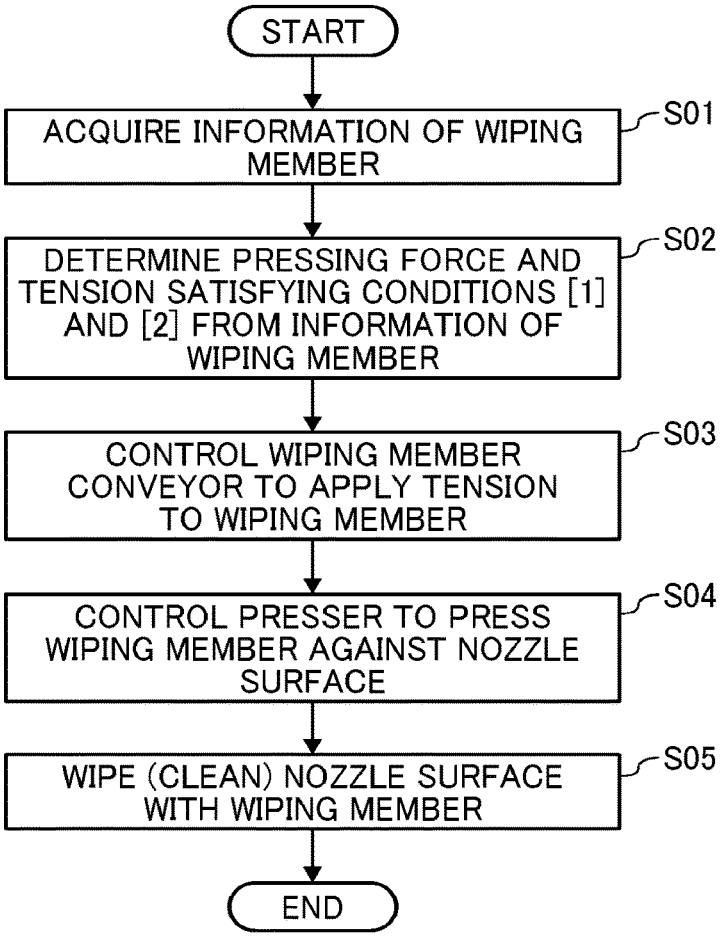
FIG. 7 is a flowchart illustrating an exemplary cleaning method according to an embodiment of the present disclosure.
Figure 8:
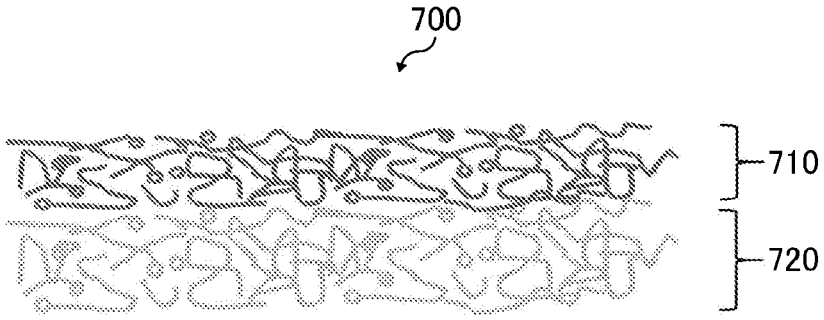
FIG. 8 is a schematic diagram illustrating a cross section of an example of a wiping member.

FIG. 7 is an exemplary flowchart illustrating the cleaning method according to the present embodiment.

As illustrated in FIG. 7, information of the wiping member 320 of the liquid discharging device 1000 is acquired (S01) before actual wiping. Based on the acquired information of the wiping member 320, the pressing force and the tension required to satisfy the above conditions 1 and 2 are determined (S02).

Depending on the value determined in the step S02, the controller 32 controls the wiping member conveyor 34 to adjust the rate of delivery from the feed roller 410 and the rate of winding-up around the wind-up roller 420, whereby the tension is applied to the wiping member 320 (S03).

Likewise, depending on the value determined in the step S02, the controller 32 controls the pressing member 33 so that the pressing roller 400 presses the wiping member 320 against the nozzle surface 41 (S04).

Under the above conditions 1 and 2, due to the action by the wiping member conveyor 34, the wiping member 320 wipes (cleans) the nozzle surface 41 (S05).

The liquid discharging device 1000 according to the present embodiment may include a cleaning liquid application device 430 configured to apply a cleaning liquid to the wiping member 320 so that the wiping member 320 impregnated with the cleaning liquid wipes the nozzle surface 41.

The volume of the cleaning liquid with which the wiping member 320 is impregnated in the area in contact with the nozzle surface 41 may be 90 percent or more of the volume of the target foreign matter (ink 500) on the nozzle surface 41. When the ink adhering to the nozzle surface 41 is removed by the wiping member 320 sufficiently impregnated with the cleaning liquid, damage to the nozzle surface 41 can be reduced. Specifically, damage to a water-repellent film on the nozzle surface 41 can be reduced.

Also, it is preferable that the cleaning liquid applied during wiping dissolve and swell the ink 500 adhering to the nozzle surface 41 to easily wipe off the ink 500 and serve as a lubricant during wiping. The ink 500 adhering to the nozzle surface 41 that has been scraped off and the pigment contained in the ink 500 act like an abrasive and may cause abrasion during wiping, thereby degrading the water-repellent film on the nozzle surface 41.

The cleaning liquid may be made of any components and can be suitably selected to suit to a particular application. For example, the cleaning liquid may contain water, an organic solvent, a surfactant, and other optional components.

The organic solvent has no specific limit and can be suitably selected to suit to a particular application. For example, water-soluble organic solvents are usable.

The surfactant has no particular limit and can be suitably selected to suit to a particular application. For example, fluorochemical surfactants, anionic surfactants, nonionic surfactants, and amphoteric surfactants are usable. These can be used alone or in combination.

There is no specific limitation to the water and it can be suitably selected to suit to a particular application. For example, pure water such as deionized water, ultrafiltered water, reverse osmosis water, and distilled water and ultra pure water are suitable. These can be used alone or in combination.

The other optional components are not particularly limited and can be suitably selected to suit to a particular application. Examples include, but are not limited to, defoaming agents, preservatives and fungicides, pH regulators, and corrosion inhibitors.

The wiping member 320 may include a laminar structure (laminate) 700. The laminate 700 strikes a higher level of balance between the above-described condition 1 (contact ratio) and the condition 2 (porous volume per unit area) under the pressure during wiping.

The wiping member 320 may include at least a wiping layer 710 and a liquid-absorbing layer 720, the wiping layer 710 being configured to be in contact with the nozzle surface 41. The use of a liquid-absorbable material for a layer not on the wiping side can improve liquid absorbency and also prevent absorbed liquid from re-transferring to the nozzle surface 41, which decreases the cleaning efficiency.

Examples of other layers that may constitute the laminate 700 include, but are not limited to, a structure-supporting layer to improve the strength of the liquid-absorbing layer and a film layer to prevent strike-through of liquid as well as to maintain the structure and enhance the strength.

The laminate 700 may have any configuration, such as the following configurations.

Configuration Example 1 (from the side in contact with the nozzle surface 41)

Wiping layer 710/structure-supporting layer/liquid-absorbing layer 720

Configuration Example 2 (from the side in contact with the nozzle surface 41)

Wiping layer 710/liquid-absorbing layer 720/film layer

Examples of materials of the wiping layer 710 include, but are not limited to, non-woven fabrics, woven fabrics, and knitted fabrics made of semi-synthetic fibers such as cupra and rayon and synthetic fibers such as PET, PP, PE, Ny, and acrylic. Of these, non-woven fabrics made of synthetic fibers such as PET, PP, and PE are preferably used.

Synthetic fibers are preferably used because they are harder than cellulose fibers so that, in particular, wiping off the ink 500 adhering to the nozzle surface 41 becomes more efficient.

Examples of materials of the liquid absorbing layer 720 include, but are not limited to, the materials of the wiping layer 710 and porous matter made of PVA, an olefin resin, etc.

In particular, non-woven fabrics with many pores and porous bodies may be used in terms of the absorption amount.

For the material of the liquid absorbing layer 720, a material that provides suitable absorbency may be selected depending on the type of ink to be removed. For example, to wipe off aqueous ink, cellulose fibers and PVA are suitable. In the case of latex ink or oil ink, which has a high resin content, synthetic fibers such as PP and PET are suitable.

Having generally described preferred embodiments of this disclosure, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, embodiments of the present disclosure are described in detail with reference to Examples but are not limited thereto.

Example 1

0.1 mL of ink (RICOH Pro AR Ink White, manufactured by Ricoh Co., Ltd.) was dripped onto the nozzle surface of a liquid discharging head (MH5440 manufactured by Ricoh Co., Ltd.) and thereafter left and dried in an environment at a temperature of 32 degrees C. and a humidity of 30 percent for 15 hours, thereby forming ink adhering to the nozzle surface.

A non-woven fabric laminate including a wiping layer and a liquid-absorbing layer was used as the wiping member.

Wiping layer (A1): polyolefin fiber non-woven fabric, fineness: 3d

Liquid-absorbing layer (B1): rayon fiber non-woven fabric, fineness: 3d

The configuration of the laminate is shown in Table 1.

The wiping member was impregnated with a cleaning liquid in an amount of 90 percent or more of the volume of the ink adhering to the nozzle surface.

The formulation of the cleaning liquid was as follows:

| Composition of Cleaning Liquid | |
|---|---|
| 3-methoxy-3-methyl-1-butanol (manufactured by KURARAY CO., LTD.): | 20 percent by mass |
| Polyether-modified silicone surfactant (WET270, Evonik Degussa Japan Co., Ltd.): | 1 percent by mass |
| Deionized water: | Balance |

For the wiping member, the pressure on the nozzle surface and the tension were adjusted so that the following conditions 1 and 2 were satisfied, and the ink adhering to the nozzle surface was removed.

Condition 1: Contact ratio of the wiping member with the nozzle surface was 40 percent Condition 2: Porous volume per unit area of 0.4 ($mm^3/mm^2$).

Values of these conditions are shown in Table 1.

The contact ratio with the nozzle surface was calculated from the image of the contact part obtained by sandwiching the wiping member between transparent glass plates G, securing the wiping member 320 under a press load applied during wiping, and making an observation using a laser microscope, as illustrated in FIG. 5A.

The porous volume per unit area was calculated by the following relation. In the relation, V (%) represents a porosity of the wiping member, and T (mm) represents a thickness of the wiping member.

$$V \times T/100$$

Porosity V (%) is calculated by the following relation using the ratio of the actually measured density A obtained by measuring the basis weight of the wiping member to the theoretical density B of the material of the wiping member.

$$\{1-(A/B)\} \times 100$$

The efficiency of removal of the ink adhering to the surface nozzle from the nozzle surface was evaluated according to the following criteria.

The results are shown in Table 1.

Evaluation

A: Ink on nozzle surface was removed by three wiping operations.

B: Ink on nozzle surface was removed by four or five wiping operations.

C: Ink remaining on nozzle surface after five wiping operations.

A and B are practically allowable.

Examples 2 to 8

The ink adhering to the nozzle surface was removed and removal efficiency was evaluated in the same manner as in Example 1 except that the contact ratio (condition 1) and the porous volume (condition 2) of the wiping member were as shown in Table 1.

The results are shown in Table 1.

Example 9

The ink adhering to the nozzle surface was removed and removal efficiency was evaluated in the same manner as in Example 1 except that the liquid-absorbing layer constituting the wiping member was made of a polyolefin porous body and the contact ratio (condition 1) and the porous volume (condition 2) were as shown in Table 1.

The results are shown in Table 1.

Example 10

The ink adhering to the nozzle surface was removed and removal efficiency was evaluated in the same manner as in Example 1 except that the wiping member was made of a polyolefin fiber non-woven fabric (0.6 mm thick) alone and the contact ratio (condition 1) and the porous volume (condition 2) were as shown in Table 1.

The results are shown in Table 1.

Comparative Examples 1 to 4

The ink adhering to the nozzle surface was removed and removal efficiency was evaluated in the same manner as in Example 1 except that the contact ratio (condition 1) and the porous volume (condition 2) of the wiping member were as shown in Table 2.

The results are shown in Table 2.

TABLE 1

| | Example 1 | Example 2 | Example 3 | Example 4 | Example 5 |
|---|---|---|---|---|---|
| Wiping layer | A1 | A1 | A1 | A1 | A1 |
| Liquid-absorbing layer | B1 | B1 | B1 | B1 | B1 |
| Contact ratio (%) | 60 | 70 | 70 | 70 | 70 |
| Porous volume | 0.4 | 0.4 | 0.1 | 0.7 | 0.3 |
| Evaluation | A | A | B | B | A |

| | Example 6 | Example 7 | Example 8 | Example 9 | Example 10 |
|---|---|---|---|---|---|
| Wiping layer | A1 | A1 | A1 | A1 | A2 |
| Liquid-absorbing layer | B1 | B1 | B1 | B2 | — |
| Contact ratio (%) | 70 | 80 | 95 | 70 | 70 |
| Porous volume | 0.5 | 0.4 | 0.4 | 0.4 | 0.4 |
| Evaluation | A | A | B | A | B |

TABLE 2

| | Comparative Example 1 | Comparative Example 2 | Comparative Example 3 | Comparative Example 4 |
|---|---|---|---|---|
| Wiping layer | A1 | A1 | A1 | A1 |
| Liquid-absorbing layer | B1 | B1 | B1 | B1 |

TABLE 2-continued

| | Comparative Example 1 | Comparative Example 2 | Comparative Example 3 | Comparative Example 4 |
|---|---|---|---|---|
| Contact ratio (%) | 55 | 98 | 70 | 70 |
| Porous volume | 0.4 | 0.4 | 0.05 | 0.72 |
| Evaluation | C | C | C | C |

The configurations A1, A2, B1, and B2 of the wiping member in Table 1 and Table 2 are as follows.

Wiping Layer

A1: Polyolefin fiber non-woven fabric, fineness: 3d

A2: Polyolefin fiber non-woven fabric, fineness: 3d (integrated with liquid-absorbing layer)

Liquid-Absorbing Layer

B1: Rayon fiber non-woven fabric, fineness: 3d

B2: Polyolefin porous body

As seen in the results shown in Table 1 and Table 2, when the wiping member under a pressure during wiping is in contact with the nozzle surface at a contact ratio of from 60 to 95 percent and has a porous volume per unit area of 0.1 to 0.7 ($mm^3/mm^2$), the ink adhering to the nozzle surface can be efficiently removed.

Having now fully described embodiments of the present invention, it will be apparent to one of ordinary skill in the art that many changes and modifications can be made thereto without departing from the spirit and scope of embodiments of the invention as set forth herein.

The invention claimed is:

1. A liquid discharging device comprising:

a liquid discharging head comprising a nozzle surface and at least one nozzle, wherein the liquid discharging head is configured to discharge liquid through the at least one nozzle;

a wiping member configured to wipe a nozzle surface of the liquid discharging head; and a pressing member configured to press the wiping member against the nozzle surface when the wiping member wipes the nozzle surface, wherein the wiping member satisfies the following conditions 1 and 2 when the wiping member is pressed against the nozzle surface by the pressing member during wiping:

a contact ratio of the wiping member with the nozzle surface is from 60 to 95 percent, Condition 1, a porous volume per unit area represented by $V \times T/100$ is from 0.1 to 0.7, in $mm^3/mm^2$, where V, percent, represents a porosity and T, in mm, represents a thickness of the wiping member, Condition 2.

2. The liquid discharging device according to claim 1, further comprising a controller configured to control the pressing member.

3. The liquid discharging device according to claim 2, wherein the controller is configured to adjust a pressing force by the pressing member with which the wiping member is pressed against the nozzle surface.

4. The liquid discharging device according to claim 2, further comprising a wiping member conveyor comprising a feed roller configured to deliver the wiping member and a wind-up roller configured to wind up the wiping member, wherein the wiping member conveyor is configured to longitudinally convey the wiping member stretching the wiping member between the feed roller and the wind-up roller, wherein the controller is configured to adjust a tension of the wiping member stretched between the feed roller and the wind-up roller.

5. The liquid discharging device according to claim 2, wherein the controller is configured to adjust a pressing force of the pressing member to be 5 N or less.

6. The liquid discharging device according to claim 1, further comprising a cleaning liquid application device configured to apply a cleaning liquid to the wiping member to impregnate the wiping member with the cleaning liquid.

7. The liquid discharging device according to claim 6, wherein a volume of the cleaning liquid with which an area of the wiping member in contact with the nozzle surface is impregnated is at least 90 percent of a volume of a target foreign matter on the nozzle surface.

8. The liquid discharging device according to claim 1, wherein the wiping member comprises a laminate made of a plurality of materials.

9. The liquid discharging device according to claim 8, wherein the wiping member comprises at least a wiping layer and a liquid-absorbing layer, wherein the wiping layer is configured to be brought into contact with the nozzle surface.

10. A cleaning method comprising:

pressing a wiping member by a pressing member against a nozzle surface of a liquid discharging head comprising at least one nozzle through which liquid is discharged and wiping the nozzle surface, wherein the wiping member satisfies conditions 1 and 2 when the wiping member is pressed against the nozzle surface by the pressing member during wiping:

a contact ratio of the wiping member with the nozzle surface is from 60 to 95 percent, Condition 1, a porous volume per unit area represented by $V \times T/100$ is from 0.1 to 0.7, in $mm^3/mm^2$, wherein V, in percent, represents a porosity and T, in mm, represents a thickness of the wiping member, Condition 2.

* * * * *